US010242602B2

(12) United States Patent
Heinrichs

(10) Patent No.: US 10,242,602 B2
(45) Date of Patent: Mar. 26, 2019

(54) MERCHANDISE MARKING TAG

(71) Applicant: Bedford Industries, Inc., Worthington, MN (US)

(72) Inventor: Curtis J. Heinrichs, Sibley, IA (US)

(73) Assignee: Bedford Industries, Inc., Worthington, MN (US)

( * ) Notice: Subject to any disclaimer, the term of this patent is extended or adjusted under 35 U.S.C. 154(b) by 0 days.

(21) Appl. No.: 15/969,000

(22) Filed: May 2, 2018

(65) Prior Publication Data

US 2019/0005852 A1 Jan. 3, 2019

Related U.S. Application Data

(60) Provisional application No. 62/527,477, filed on Jun. 30, 2017.

(51) Int. Cl.
*G09F 3/14* (2006.01)
*G09F 3/02* (2006.01)

(52) U.S. Cl.
CPC . *G09F 3/14* (2013.01); *G09F 3/02* (2013.01)

(58) Field of Classification Search
CPC .... G09F 3/16; G09F 3/206; G09F 2003/0267; G09F 3/14; A01G 9/006
USPC ..... 40/316, 322, 645, 662, 665; 116/237; D20/22
See application file for complete search history.

(56) References Cited

U.S. PATENT DOCUMENTS 2,077,285 A 4/1937 Thackeray et al.
2,222,535 A 11/1940 Henry, Jr.
2,510,053 A 6/1950 Pfeiffer
2,717,572 A 9/1955 Kingman
2,738,061 A 3/1956 Roth
3,381,654 A 5/1968 Hupp et al.
3,927,443 A 12/1975 Brumlik
5,167,086 A * 12/1992 Fast ..... G09F 3/16 24/16 PB
D335,686 S 5/1993 Christian
5,617,656 A 4/1997 Ludlow et al.
(Continued)

OTHER PUBLICATIONS

Star Stuff Group marketing materials on web related to Snap-A-Tag products, showing images of product available to the public prior to Jun. 30, 2016—https://www.starstuffgroup.com.au/allaboutpackaging/snap-a-tag/ (4 pages).

(Continued)

*Primary Examiner* — Joanne Silbermann

(74) *Attorney, Agent, or Firm* — Westman, Champlin & Koehler, P.A.; Mai-Tram D. Lauer

(57) ABSTRACT

A marking tag is configured to attach to a product via a band. The tag includes a body formed of a sheet material and configured with an interior area defined by a perimeter cut. An interior cut is disposed in the interior area, the interior cut defining a triangular portion. The interior cut is configured to guide the band past the triangular portion. The interior area does not have any sheet material removed therefrom. In another aspect, a method of attaching a marking tag to a product via a band is described. The method includes obtaining the marking tag, guiding the band along the interior cut past the triangular portion of the marking tag, and retaining the tag relative to the product via frictional engagement of the band and the tag along the interior cut.

17 Claims, 4 Drawing Sheets

(56) References Cited

U.S. PATENT DOCUMENTS

| | | | | |
|---|---|---|---|---|
| 5,697,177 | A | 12/1997 | Ludlow et al. | |
| 5,913,619 | A | 6/1999 | Lowe | |
| D412,535 | S | 8/1999 | Tinklenberg et al. | |
| 5,943,804 | A | 8/1999 | Linquist et al. | |
| 6,058,639 | A | 5/2000 | Tinklenberg et al. | |
| 6,145,233 | A * | 11/2000 | Hickmott | G09F 3/04 40/645 |
| D519,560 | S | 4/2006 | Roewe | |
| D542,356 | S | 5/2007 | Lovejoy, Jr. | |
| D623,698 | S | 9/2010 | Muniz et al. | |
| D672,159 | S | 12/2012 | Lee | |
| 9,355,577 | B1 | 5/2016 | Coleman et al. | |
| D784,455 | S | 4/2017 | Sims et al. | |

OTHER PUBLICATIONS

Bedford Industries flyer entitled "Bedford Produce Ties & Tags"—showing images of product available to the public prior to Jun. 30, 2016 (2 pages).
Photo of produce tags of Cal-Organic Farms, showing tags available to the public prior to Jun. 30, 2016 (1 page).
Dole tag—from Bob Baker, Apr. 1, 1996.

* cited by examiner

MERCHANDISE MARKING TAG

CROSS-REFERENCE TO RELATED APPLICATION

This application claims the benefit of priority from U.S. Provisional Patent Application No. 62/527,477, filed on Jun. 30, 2017, for "Merchandise Marking Tag;" this application is fully incorporated herein by reference.

BACKGROUND

The banding of merchandise into groups of a size desired by consumers is well known and widely practiced. The band may consist of rubber, a twist-tie, or string and may be positioned about one or more bundles or clumps of merchandise or about a single item such as rolled or folded merchandise (e.g., a newspaper). A particularly popular and well-known practice is that of banding clumps of agricultural produce for easy handling in supply channels and attractive display to consumers.

The marking of banded bundles of merchandise with the necessary information for inventory control and accuracy of processing by scanning (as at supermarket check-out counters), as well as for attractiveness of display for the consumer, has led to the development of marking tags having varied styles of hooks and varied holes, openings, or orifices for receiving the band material. The known varied styles of tags having hooks, however, are associated with a single orifice and cause a tag on the banded merchandise to be in an angular relationship with respect to the band. Other tags require the exercise of too much effort, skill and labor time to get properly fixed on the band or are easily dislodged from the band about merchandise, which makes them undesirable or unreliable as markers.

SUMMARY

In another aspect, a method of attaching a marking tag to a product via a band is described. The method includes obtaining the marking tag, wherein the marking tag includes a body and an interior cut. The body is formed of a sheet material and is configured with an interior area defined by a perimeter cut. An interior cut is disposed in the interior area, the interior cut defining a triangular portion. The interior area does not have any sheet material removed therefrom. The method includes guiding the band along the interior cut past the triangular portion of the marking tag, and retaining the tag relative to the product via frictional engagement of the band and the tag along the interior cut.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

Figure 2:
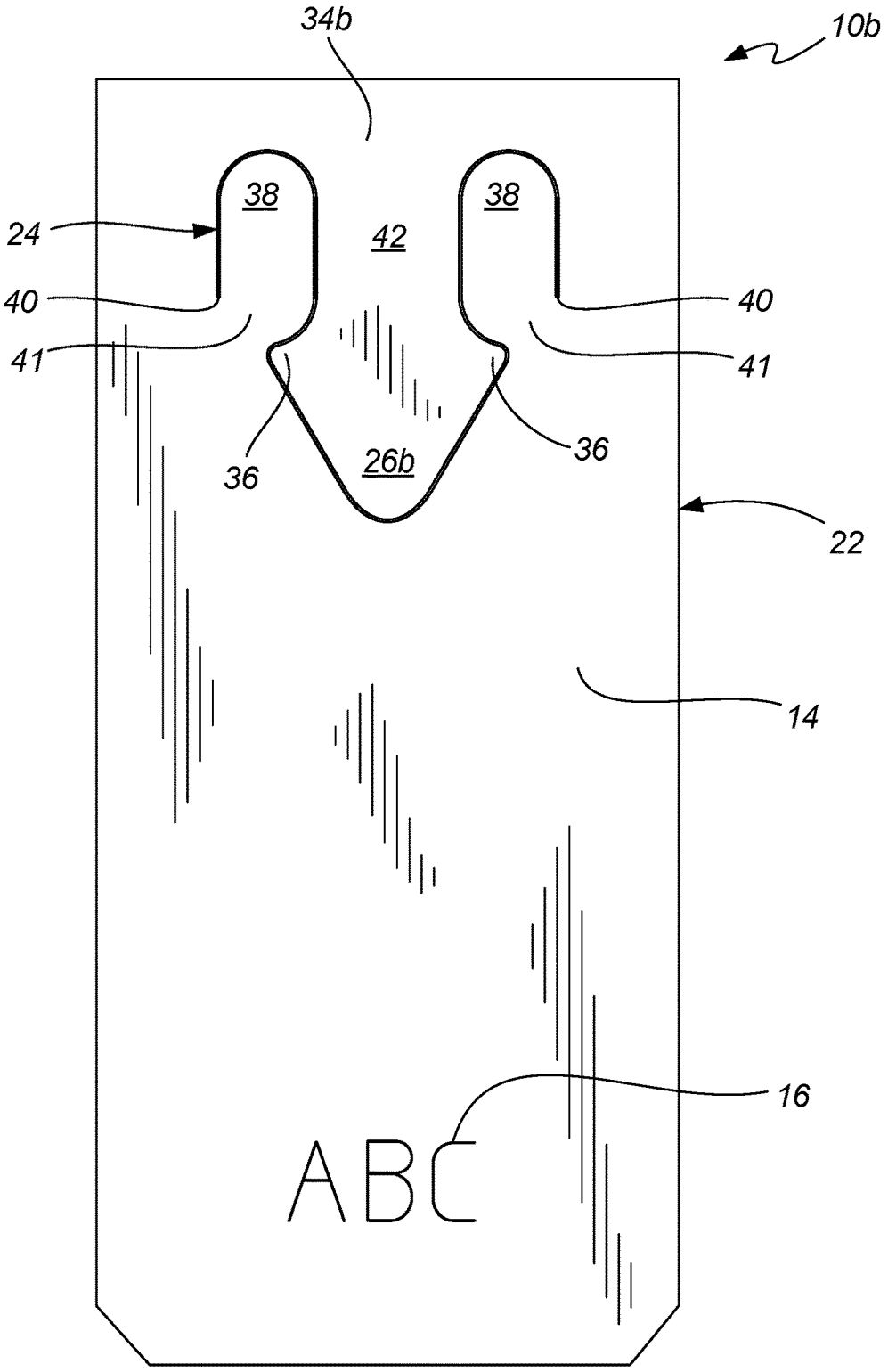
FIG. 2 is a front view of a second exemplary embodiment of a marking tag.
Figure 3:
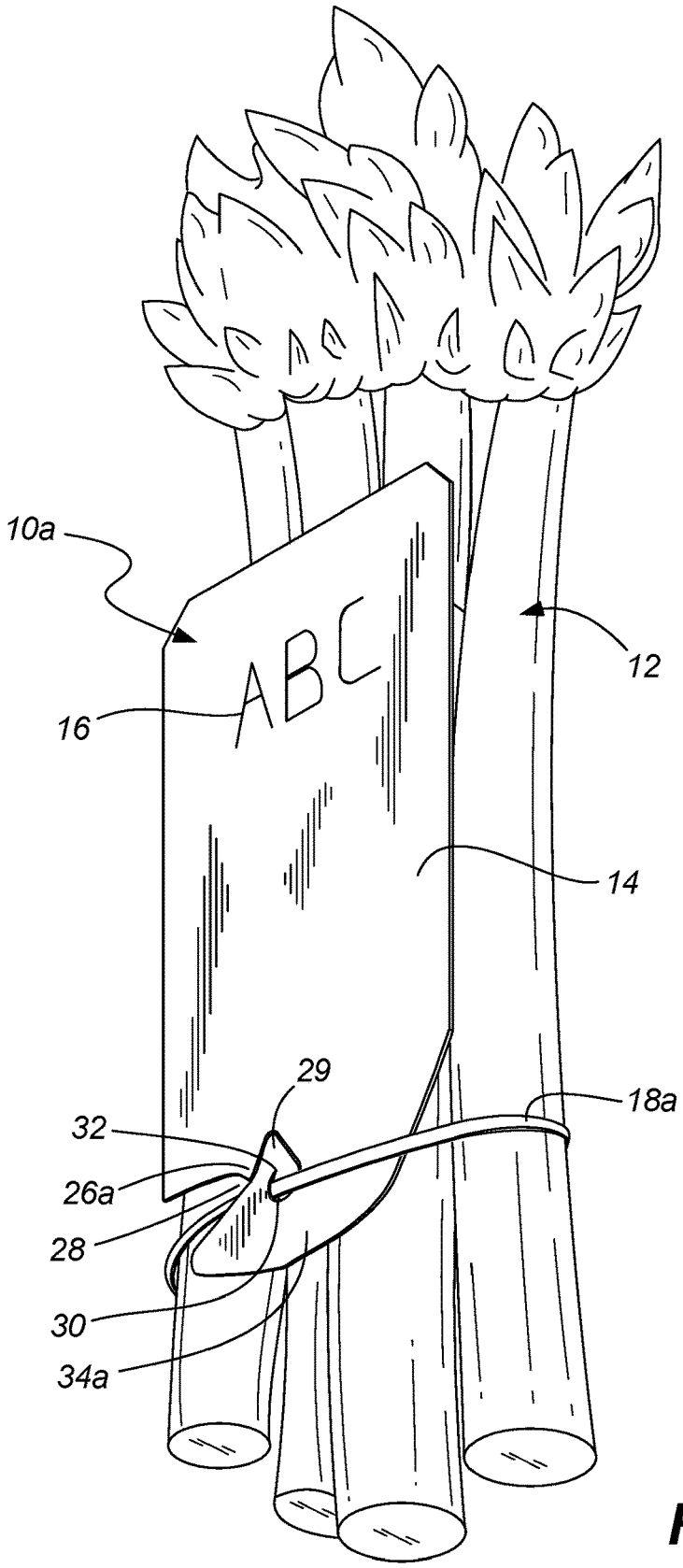
FIG. 3 is a perspective view of the tag of FIG. 1 affixed to a bundle of merchandise by a thin band.
Figure 4:
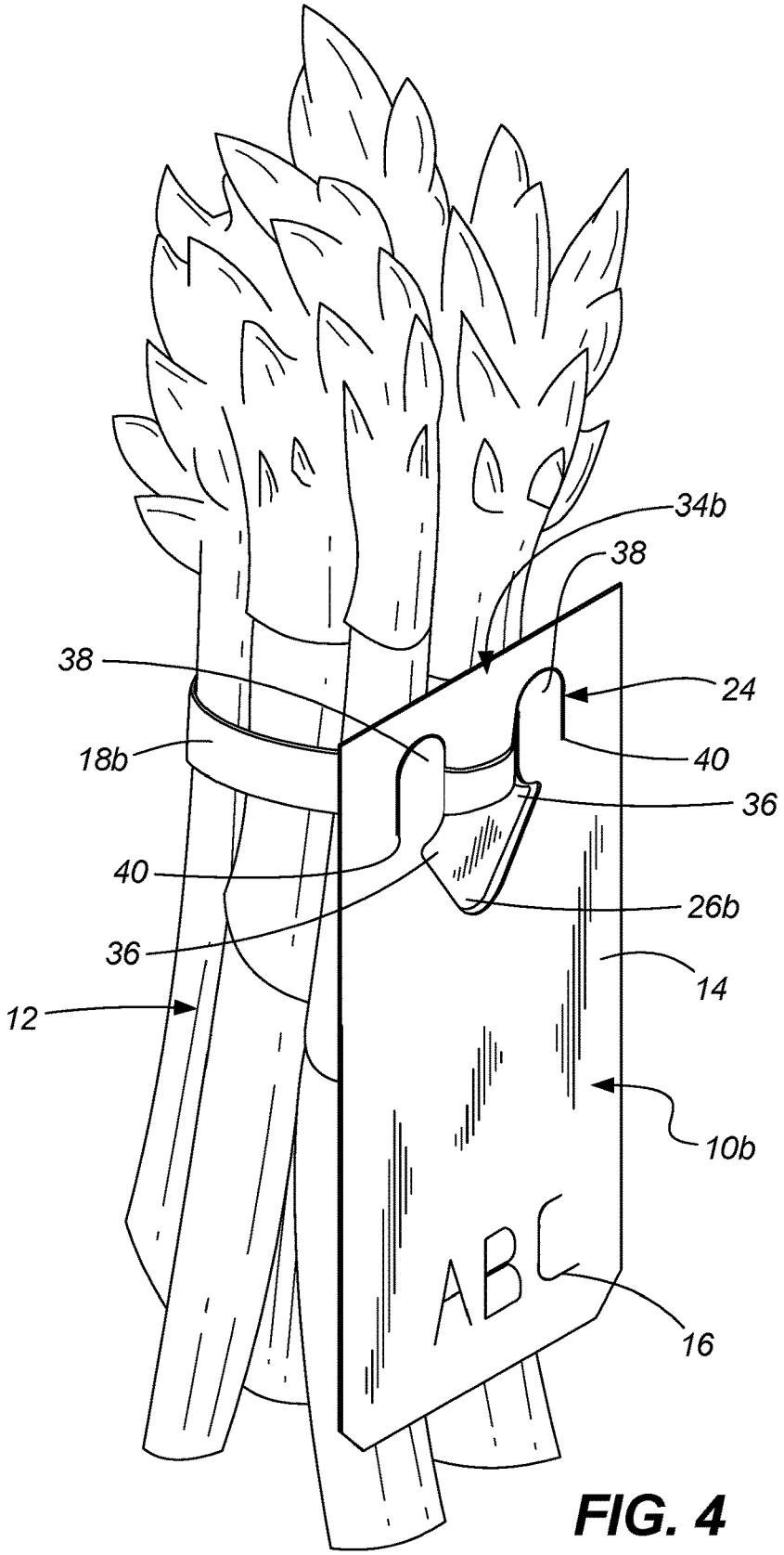
FIG. 4 is a perspective view of the tag of FIG. 2 affixed to a bundle of merchandise by a thicker band.

This disclosure relates to a marking tag 10 (referring to tag 10*a* of FIGS. 1 and 3 and tag 10*b* of FIGS. 2 and 4) for labeling merchandise 12. As shown in FIGS. 3 and 4, marking tag 10 is configured to attach to a product 12 via band 18. Marking tag 10 has a front surface 14 configured to present information, graphics, or decoration, including indicia 16 that is printed, embossed, or otherwise provided on front surface 14 in the illustrated embodiments. It is also contemplated that indicia may additionally or alternatively be provided on a back surface of tag 10. Tag 10 is configured for ready attachment to an elongated band or strap 18 (referring to band 18*a* of FIG. 3 and band 18*b* of FIG. 4) for connection to merchandise 12 (illustrated as a clump of broccoli, but may be any article or group of articles). The tag 10 has features useful for the purpose of guiding the elongated band or strap 18 into a locked or held condition, without requiring the formation of a hole or orifice in the tag 10. The band or strap 18 may be made of an elastic material such as rubber or elastomer, or may be a segment or loop of string, twine, tape, ribbon, a tie-twist fastener or another elongated element by which the tag 10 may be fastened or affixed to merchandise 12.

A particularly suitable method of use of the described tag 10 is for labeling clumps of agricultural produce 12, especially at the time of harvesting. Suppliers and mass merchandising outlets such as superstores or supermarkets desire scannable merchandise markings as an important means for controlling and tracking inventory. A feature of marking tags 10 is that they are easy to attach to bands 18, either manually or automatically using application equipment, and stay in place on the merchandise 12 during the several handling, transport, and processing steps in preparing the merchandise 12 for sale to consumers.

Marking tags 10 facilitate quick and successful tag affixation to merchandise 12 with minimal worker or machine motions. Speed in affixing a marking tag 10 to agricultural produce 12 at the time of harvesting, for example, is desirably accompanied by reliability of tag affixation and avoidance of tag damage during cleaning, washing, or other steps in moving the produce 12 through harvesting, processing, and marketing channels to the ultimate consumer. Easy and quick affixation without damage to the merchandise and without significant tag loss as a consequence of normal handling are desirable.

The illustrated embodiments of exemplary tags 10 show just two variations according to the present disclosure. It is contemplated that many other changes in form and configuration are possible that fall within the scope of the present description. As shown in FIGS. 3 and 4, marking tag 10 is easily affixed to a band 18. In this discussion, the term "band" will be used to refer to any suitable elongated component to which tag 10 may be attached, such as segment or loop of a band, strap, string, tape, rod, twist-tie, tin-tie, stem, or vine, for example. Band 18 can be positioned on or attached to merchandise 12, as illustrated, or may be an inherent part of merchandise 12 (such as a tomato vine, for example). Where the band 18 is elastic, attaching the band 18 to merchandise 12 can include stretching the band. Where the merchandise includes a plurality of elements, attaching the band 18 to merchandise 12 can include bundling the plurality of elements together with band 18.

Figure 1:
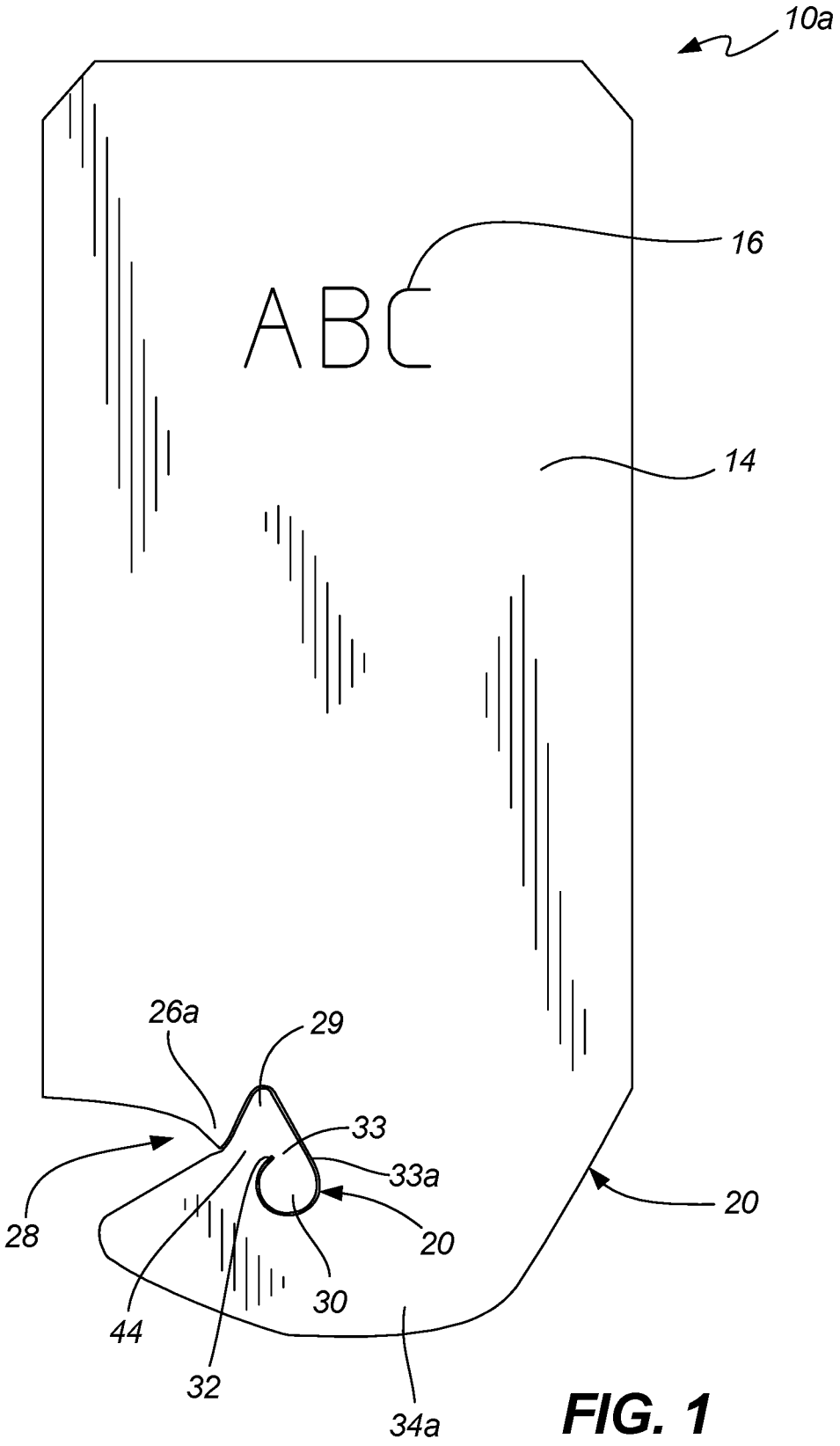
FIG. 1 is a front view of a first exemplary embodiment of a marking tag.

In exemplary embodiments, tag 10*a* of FIG. 1 is formed with a cut line 20 that is continuous and is formed in an exemplary embodiment by a single pass through a cutting die (not shown). Tag 10*b* of FIG. 2 is formed with a perimeter cut line 22 that is continuous, and a separate interior cut line 24. Tag 10*a* has a body formed of a sheet material and is configured with an interior area defined by a perimeter portion of cut line 20. Tag 10*b* has a body formed of a sheet material and is configured with an interior area defined by perimeter cut line 22.

In an exemplary method of production, both cut lines 22, 24 are formed simultaneously in an exemplary embodiment by a single pass through a cutting die (not shown). A common feature of tags 10*a*, 10*b* is that there are no interior holes or orifices through the tag surface in communication with cut lines 20 or 24. Such interior holes or orifices would require the removal and processing of scrap material during the formation of tags. Additionally, the formation of interior holes or orifices often requires two passes through die cutters: one pass to punch the holes and another pass to make curvilinear and convoluted cuts such as cuts 20 and 24. Accordingly, the tags 10*a*, 10*b* offer advantages of quicker and easier manufacturing because arrays of each can be cut from a sheet of material during a single cutting pass, and the process results in less material waste (i.e., no hole cut-out waste).

Additionally, front surface 14 (of tags 10*a*, 10*b* such as shown in FIGS. 1 and 2) provides more surface area for a visual presentation or display of colors, graphics, or indicia 16, as no interior portion of front surface 14 inside of the tag perimeter is removed. Another advantage of the absence of interior holes or orifices is that tag 10 is more securely and frictionally held by band 18, which contacts the surfaces of tag 10 about cut 20, 24. In contrast, with the prior art tags having holes therein, the tag merely hangs from a string (or the like) inserted through the hole. In the illustrated embodiments of tag 10, because the die-cut line 20, 24 does not remove sheet material from the interior of the tag 10, a maximum resilient closure effect is obtained between tag 10 and band 18. The additional frictional engagement between tag 10 and band 18 offered by the configuration of tag 10 allows for a relative orientation of tag 10 and product 12 to be more affirmatively maintained, compared to conventional tags having interior holes (i.e., sheet material removed from an interior area of tag 10 defined by perimeter cut line 22 or the perimeter of cut line 20).

In exemplary embodiments of tag 10, each interior cut (i.e., a portion of cut line 20 in the interior area of tag 10*a* or interior cut line 24 of tag 10*b*) has a relatively smooth curvilinear shape to smoothly contact and guide band 18 to a desired attached location. Another common feature of tags 10*a*, 10*b* is that each of cuts 20, 24 forms a triangular portion 26*a*, 26*b* on each tag 10*a*, 10*b*, respectively, with each triangular portion 26*a*, 26*b* configured to pass downward relative to a segment of band 18 to attach tag 10 to band 18. On tag 10*a*, the interior cut portion of line 20 is configured to guide band 18*a* past triangular portions 26*a* and 29. On tag 10*b*, the interior cut 24 is configured to guide band 18*b* past triangular portion 26*b*. As shown, the embodiment of tag 10*a* is especially suitable for use with a relatively narrow band 18*a*, and the embodiment of tag 10*b* is especially suitable for use with a wider band 18*b*.

As shown in FIG. 1, cut line 20 of tag 10*a* has a continuous, curvilinear, spiraling shape that includes a perimeter portion that is continuous with an interior portion. The illustrated configuration of cut line 20 results in a tag 10*a* with a substantially triangular perimeter notch 28, triangular portion 29, triangular portion 26*a* (opposed to triangular portion 29), and a rounded portion 30, with cut 20 ending at terminus 32. Rounded portion 30 is connected to the rest of tag 10*a* solely by bridge area 33, disposed between terminus 32 and a linear portion 33*a* of cut 20, as seen in FIG. 1. Additionally, triangular portion 29 is connected to end portion 34*a* of tag 10*a* by bridge area 44.

As shown in FIG. 3, in an exemplary method for attaching tag 10*a* to band 18*a*, a user positions an end portion 34*a* of tag 10*a* under band 18*a* so that a portion of band 18*a* slips into notch 28. Referring to FIG. 3, by moving tag 10*a* toward the left direction shown in the drawing, band 18*a* automatically falls into the interior portion of cut 20 and is guided along the interior portion of cut 20. Once band 18*a* passes to the bottom of round portion 30, the user moves tag 10*b* toward the right direction shown in the drawing to guide band 18*a* along the interior portion of cut 20 toward terminus 32 of cut 20. Thus, by guiding band 18*a* past triangular portion 26*a*, triangular portion 29, linear portion 33*a*, and rounded portion 30, the user can easily and securely attach tag 10*a* to band 18*a*, and therefore to merchandise 12 attached to or bundled by band 18*a*. The guidance of band 18*a* into notch 28 and along convoluted cut 20 toward its terminus 32 is easily accomplished by a sweeping hand motion of the user. The rounded portion of cut 20 that surrounds round portion 30 serves as a feature past triangular portion 29 that is configured to retain band 18*a* past the triangular portion 29.

It is conceivable that the user might fail to cause band 18*a* to slide up to terminus 32. Nevertheless, it is contemplated that a joint of band 18*a* and tag 10*a* at any location past a tip of triangular portion 26*a* will be adequate to attach tag 10*a* to band 18*a* and deter unintentional mutual detachment. The material of tag 10*a* surrounds the captured portion of band 18*a* in all directions at the area where band 18*a* extends through cut 20. Accordingly, the frictional engagement of tag 10*a*, band 18*a* and merchandise 12 at the area between tag 10*a* and band 18*a* inhibits relative motion and therefore decreases the susceptibility of detachment of tag 10*a* from band 18*a*. Additionally, in a case where band 18*a* has elastic properties (such as a rubber band, for example), the compressive forces exerted by band 18*a* further contribute to the attachment of tag 10*a* to merchandise 12. A tag 10 as configured, wherein passage of a band therethrough is accomplished via a cut rather than a hole, tends to better hold tag 10*a* in a desired display position relative to merchandise 12 than a tag with a hole. For example, with tag 10 as configured, an affirmative hold is accomplished by the material contact between tag 10 and band 18. In contrast, in a tag wherein the band passes through a hole, undesirable motion of the tag can be caused by slippage of the tag about the band, as the tag is suspended from the band inserted through its hole.

As shown in FIG. 2, in an exemplary embodiment of tag 10*b*, a substantially rectangular perimeter cut 22 is not continuous or in communication with interior cut 24. However, because there is no need to remove scrap material from an interior of surface 14, cuts 22 and 24 in an exemplary embodiment can be formed simultaneously in a single pass through a die cutter. In the illustrated embodiment, interior cut 24 of tag 10*b* has a continuous, curvilinear configuration that results in triangular portion 26*b*, two triangular wings 36, two oval-shaped ears 38, and two ends at termini 40. The wing portions of cut 24 that surround wings 36 serve as features past triangular portion 26*b* that are configured to retain band 18*b* past the triangular portion 26*b*. Each ear 38 is connected to the rest of 10*b* solely by bridge area 41, disposed between its respective terminus 40 and triangular wing 36 of cut 24, as seen in FIG. 2.

As shown in FIG. 4, in an exemplary method for attaching tag 10*b* to band 18*b*, a user pushes back on triangular portion 26*b* to form a slip passage for band 18*b* at cut 24, slips triangular portion 26*b* behind band 18*b*, and pulls downward on tag 10*b* to lodge a portion of band 18*b* across a bridge area 42 of tag 10*b* (and between ears 38 and above wings 36). The band 18*b* is thus retained within the form of cut 24 adjacent each ear 38, by a portion of the cut 24 extending over each triangular wing 36, proximate end portion 34*b*. The user thereby easily and securely attaches tag 10*b* to band 18*b*, and therefore to merchandise 12 bundled by band 18*b*. The lengths of interior cut 24 between contact points with band 18*b* and cut termini 40 allows for a greater range of motion of triangular portion 26*b* out of plane with a remainder of tag 10*b*. The additional flexibility offered by the cuts forming ears 38 allows for easier attachment of tag 10*b* to band 18*b* than a tag without the extended cut formation. Additionally, the configuration of interior cut 24 allows for different attachment arrangements than illustrated. For example, portions of band 18*b* could pass in front of ears 38 if desired. Other formations will also be suitable.

The material of tag 10*b* surrounds the captured portions of band 18*b* in all directions at the two areas where band 18*b* extends through interior cut 24. Accordingly, the frictional engagement of tag 10*b*, band 18*b* and merchandise 12 at the areas between tag 10*b* and band 18*b* inhibits relative motion and therefore decreases the susceptibility of detachment of tag 10*b* from band 18*b*, and also tends to better hold tag 10*b* in a desired display position relative to merchandise 12. Moreover, to further lodge band 18*b* against interior cut line 24, the user can pull or push upward on tag 10*b* to lock an upper surface of wings 36 against the bottom of band 18*b*. Additionally, in a case where band 18*b* has elastic properties (such as a rubber band, for example), the compressive forces exerted by band 18*b* further contribute to the attachment of tag 10*b* to merchandise 12.

While particular methods of attachment of tag 10*a*, 10*b* are illustrated in FIGS. 3 and 4, it is to be understood that the use of tag 10 can vary, depending on the configuration and type of band 18 and merchandise 12. For example, FIG. 3 shows band 18*a* attached near a bottom of tag 10*a*, while FIG. 4 shows band 18*b* attached near a top of tag 10*b*. In other applications, tags 10 can be attached any orientation relative to merchandise 12. Moreover, indicia 16 can be provided on tag 10 in any orientation to achieve a desired display effect.

In exemplary embodiments, indicia 16 include scannable bar codes for product identification such as those commonly called Universal Product Codes (UPC—a combination of bar code and numbers for product identification and usually also a price specification) and Product Look-Up (PLU) numbers. In the case of agricultural produce merchandise, indicia 16 may also include recipes, nutritional information, serving suggestions, storage directions, origin of product information (such as "Produced in the U.S.A."), and other information that may assist suppliers in monitoring inventory, consumers in making purchasing and consumption decisions, and retailers at check-out counters, for example.

As shown in FIGS. 3 and 4, tag 10 is easily and securely attachable to band 18, but is also easily removable therefrom (or repositioning thereon) by intentional motions to reverse the attachment steps. In exemplary embodiments, tag 10 is formed of a sheet material (or laminated layers of sheets materials, for example) and is generally flat in character, although tag 10 may be drapeable and floppy and thus not always displayed in flat form. Rectangular style tags 10 are especially practical for economy purposes, but tags 10 may take different forms such as octagonal shapes, triangular shapes, rhomboidal shapes, circular shapes, oval shapes, and irregular shapes.

Suitable sheet material for tag 10 is preferably relatively thin, generally not over about 15 or 40 mils (i.e., 0.015 or 0.040 inch) in thickness. The tag material should be flexible and pliable but is preferably not elastic, and is therefore dimensionally stable, for most applications. In exemplary embodiments, tag 10 is flexible but not overly so, thereby possessing some stiffness or rigidity, so that it does not deform extensively from the attachment or detachment motions relative to a band 18. In exemplary embodiments, the sheet material for the tag 10 is also sufficiently water resistant to not disintegrate and not significantly pucker or wrinkle or otherwise disfigure or deform when exposed to or placed in water. In some embodiments, indicia 16 are provided on front surface 14 and/or an opposite back surface. Such indicia 16 may be printed, embossed, or otherwise provided. In exemplary embodiments, indicia 16 are sufficiently water resistant to avoid disintegration or destruction when repeatedly subjected to water and washing operations (as is common for produce displays in supermarkets). The sheet material for tag 10 also should be somewhat tough in the sense of being sufficiently tear resistant to deter damage to it during banding, storage, transport and display, or by staff or customer handling.

Especially suitable materials for forming tag 10 include non-woven fabrics, non-woven films, paper, polystyrenic thermoplastics, polyolefinic thermoplastics, polyesters, and others that exhibit the properties discussed (which can vary depending on how the bundling article is to be used). Suitable materials include thermoplastic materials and polymers of styrene, ethylene, propylene, as well as a variety of other monomers and mixtures of monomers (e.g., to make co-polymers and ter-polymers, etc.). Any of a variety of commercially available inks compatible with, or accepted on, a tag sheet and retained thereon, and in any desired color, may be used to print indicia 16 on tag 10 if desired. Moreover, if it should be desired to use water-soluble ink markings, a thin film of water-insoluble plastic may be applied over the ink to enhance water resistance.

High-impact polystyrene sheets are especially useful as tag material. To improve impact properties, a styrene-butadiene-styrene impact modifier can be useful in amounts up to about 40 percent of the weight of the polystyrene itself. Tags 10 of such material are highly dimensionally stable against stretching and have desired flexibility balanced by a slight stiffness that contributes to ease of handing during manufacture and use. Such tags 10 also can be reliably printed, especially when first subjected to a surface treatment such as, for example, a corona treatment such as available from Pillar Technologies of Hartland, Wis., a division of Illinois Tool Works.

Those skilled in the art will recognize that any suitable process for the manufacture of the marking tags 10 of the disclosure can be employed. Batch processing is useful for limited production runs. Conveyor processing with indexing from station to station for specific operations can be useful, especially for uniquely designed or shaped tags. Web-based processing is especially suitable from the standpoint of economy. Lateral and longitudinal positioning of the web of tag material is controlled as it is passed in proper registration to die cutters and printers.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A marking tag configured to attach to a product via a band, the tag including:

a body formed of a sheet material and configured with an interior area defined by a perimeter cut; and an interior cut disposed in the interior area, the interior cut defining first and second triangular portions disposed on opposite sides of a first segment of the interior cut, and the interior cut being configured to guide the band past the first and second triangular portions and along a second segment of the interior cut toward a terminus of the interior cut;

wherein the interior area does not have any sheet material removed therefrom.

2. The tag of claim 1, wherein the perimeter cut and interior cut are continuous.

3. The tag of claim 1, wherein the interior cut is configured as a continuous curvilinear line.

4. The tag of claim 1, wherein the interior cut has a spiral configuration.

5. The tag of claim 1, wherein the triangular portion is connected to an end portion of the body by a bridge area.

6. The tag of claim 1, wherein the interior cut includes a feature past the triangular portion that is configured to retain the band past the triangular portion.

7. The tag of claim 6, wherein the feature is a round portion of the interior cut.

8. The marking tag of claim 1 wherein the first segment of the interior cut forms a side of each of the first and second triangular portions.

9. A method of attaching a marking tag to a product via a band, the method including:

obtaining the marking tag, wherein the marking tag includes:

a body formed of a sheet material and configured with an interior area defined by a perimeter cut; and an interior cut disposed in the interior area, the interior cut defining first and second triangular portions disposed on opposite sides of a first segment of the interior cut;

wherein the interior area does not have any sheet material removed therefrom;

guiding the band along the interior cut past the first and second triangular portions of the marking tag and along a second segment of the interior cut toward a terminus of the interior cut; and retaining the tag relative to the product via frictional engagement of the band and the tag along the interior cut.

10. The method of claim 9, further including attaching the band to the product.

11. The method of claim 10, wherein attaching the band to the product includes bundling a plurality of elements of the product.

12. The method of claim 10, further including stretching the band.

13. The method of claim 10, wherein guiding the band along the interior cut includes guiding the band along a continuous curvilinear line.

14. The method of claim 10, wherein guiding the band along the interior cut includes guiding the band to a terminus of the interior cut.

15. The method of claim 9, wherein guiding the band along the interior cut includes moving the tag initially in a first direction with respect to the band, and wherein guiding the band past the triangular portion includes moving the tag subsequently in a second direction that is different from the first direction.

16. The method of claim 15, wherein the second direction is opposite the first direction.

17. The method of claim 9, further including passing an end portion of the tag between the band and the product.

* * * * *